US005868184A

United States Patent [19]

Van Elten

[11] Patent Number: 5,868,184

[45] Date of Patent: Feb. 9, 1999

[54] KNIFE ASSEMBLY AND APPARATUS FOR SLICING WOODWOOL

[75] Inventor: Gerrit Jan Van Elten, Voorthuizen, Netherlands

[73] Assignee: Bau- und Forschungsgesellschaft Thermoform AG, Murten-Fribourg, Switzerland

[21] Appl. No.: 765,055

[22] PCT Filed: Jun. 13, 1995

[86] PCT No.: PCT/EP95/02280

§ 371 Date: Feb. 18, 1997

§ 102(e) Date: Feb. 18, 1997

[87] PCT Pub. No.: WO95/34416

PCT Pub. Date: Dec. 21, 1995

[30] Foreign Application Priority Data

Jun. 14, 1994 [NL] Netherlands ..... 9400961

[51] Int. Cl.[6] ..... B27C 13/00; B27C 1/00

[52] U.S. Cl. ..... 144/241; 144/162.1; 144/174; 144/218; 144/230; 144/172; 144/185; 144/186

[58] Field of Search ..... 144/162.1, 172, 144/173, 174, 185, 186, 229, 230, 241, 373, 374; 241/92, 151

[56] References Cited

U.S. PATENT DOCUMENTS

| | | | |
|---|---|---|---|
| 604,813 | 5/1898 | Ward | 144/186 |
| 624,514 | 5/1899 | MacKinnon | 144/186 |
| 1,033,202 | 7/1912 | Selle | 144/185 |
| 2,349,034 | 5/1944 | Elemendorf | 144/185 |
| 2,605,793 | 8/1952 | Humelin . | |
| 3,750,726 | 8/1973 | Buchacher | 144/172 |
| 4,077,450 | 3/1978 | Ackerman | 144/172 |

FOREIGN PATENT DOCUMENTS

| | | | |
|---|---|---|---|
| C 53 900 | 11/1990 | Germany . | |
| 160823 | 3/1933 | Switzerland | 144/186 |
| A 160 823 | 3/1933 | Switzerland . | |

*Primary Examiner*—W. Donald Bray
*Attorney, Agent, or Firm*—Darby & Darby

[57] ABSTRACT

The invention relates to a knife assembly for slicing woodwool, comprising a knife with a chip surface (1), a clearance surface (2) and a cutting edge (3), defined by the intersection between both surfaces. The knife assembly is characterized by guiding ribs (4) extending perpendicularly to the cutting edge (3) and joining the chip surface (1) with an end (5) that substantially coincides with the cutting edge (3) and with the guiding surface joining said end and rising there towards. The guiding ribs (4) can be formed integrally with the knife.

16 Claims, 4 Drawing Sheets

FIG. 1
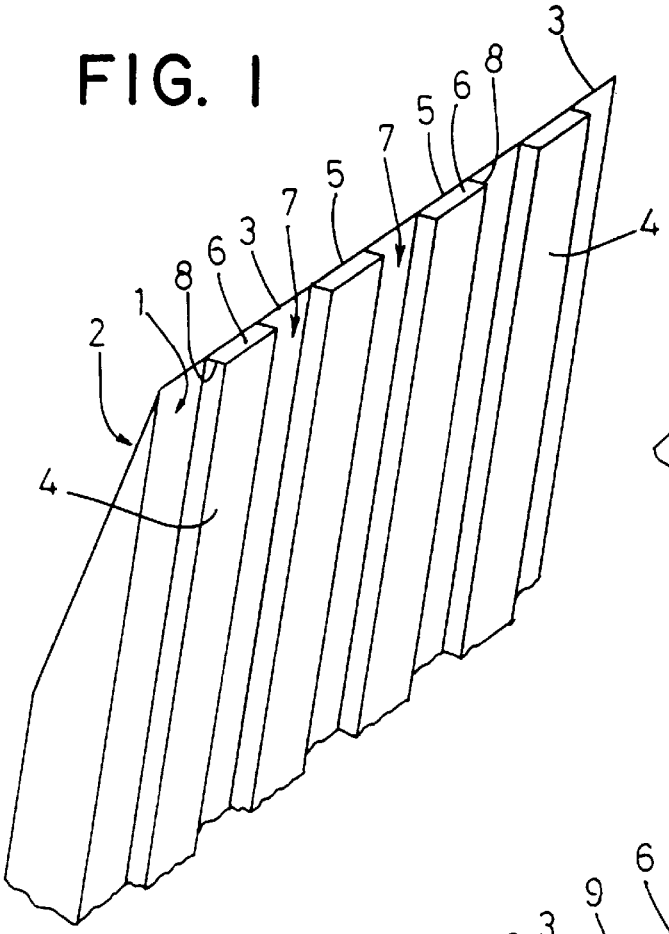
FIG. 2
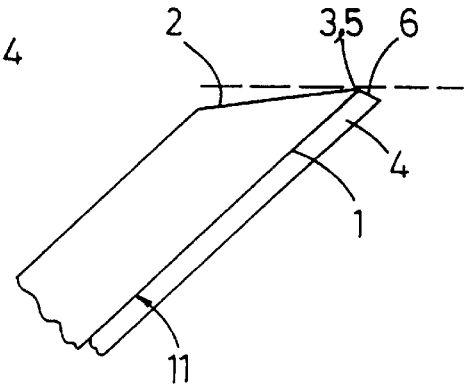
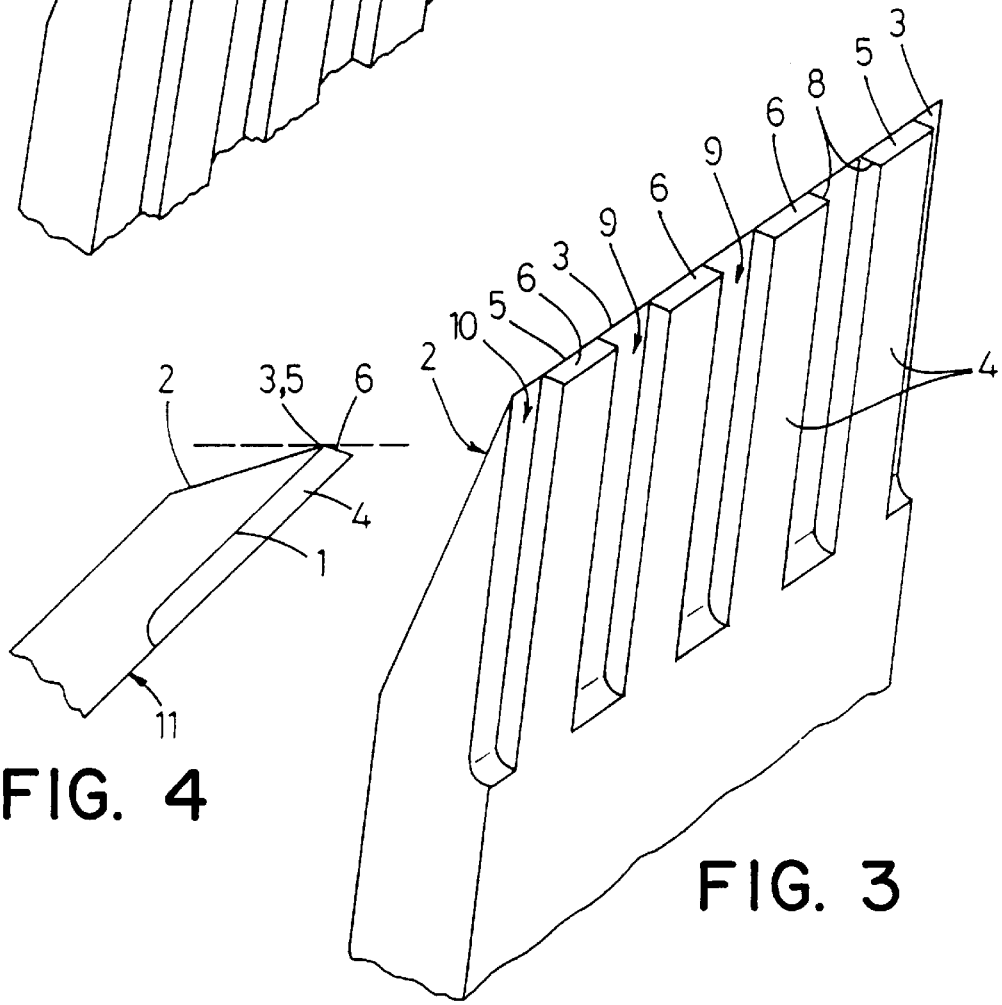
FIG. 4
FIG. 3

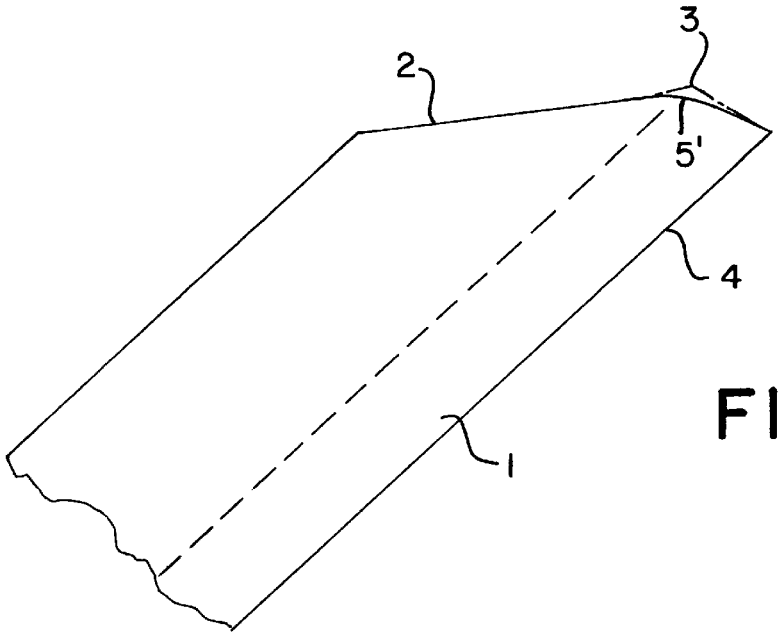
FIG. 2a
FIG. 13
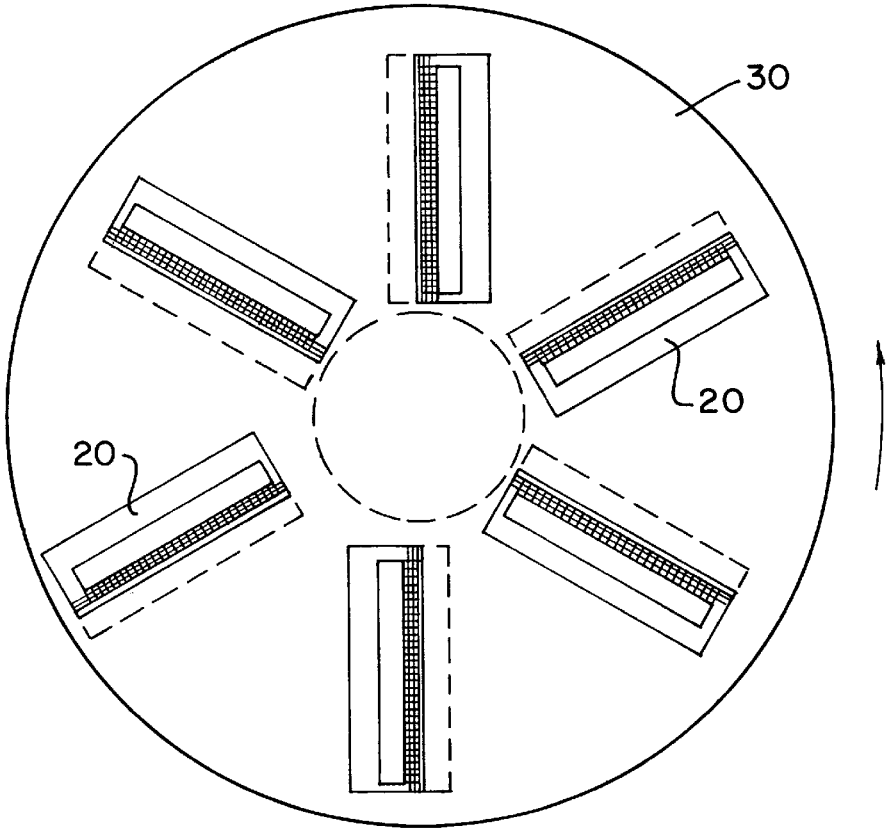

KNIFE ASSEMBLY AND APPARATUS FOR SLICING WOODWOOL

The invention firstly relates to a knife assembly for slicing woodwool, comprising a knife with a chip surface, a clearance surface and a cutting edge defined by the intersection between both surfaces.

BACKGROUND OF THE INVENTION

Woodwool (which also means "flakes" and alike) for packaging purposes and as base material for, among others, insulating cement-bonded building boards is mainly sliced using carriage planing machines. Because for the production of woodwool generally waste material of sawing mills and second rated logs are used, of which the growing fibres (the grain of the wood) mostly are not straight and because the wood often contains a lot of knots, in practice preferably only one planing knife is used. In this case the wood is clamped manually in a somewhat inclined position above the carriage of the carriage planing machine, such that during the cutting stroke the planing knife averagely cuts more "into" than "out of" the growing fibres.

For determining the width of the woodwool several measures can be taken. It is possible, that ahead of the planing knife a series of sharpenable or exchangeable width knives (so-called spurs) are mounted. Sharpenable width knives however have the disadvantage that after use they have to be collected, sorted out, sharpened individually, bundled and positioned again very carefully in the planing machine. This is labour intensive and an accurate setting is difficult. Therefore there are also solutions, according to which sets of pre-machined bundled not-sharpenable small and thin width knives are applied for one-time use. However a disadvantage thereof are the cost, whereas these small width knives are easily damaged or broken. For replacement the production of woodwool then has to be interrupted. Further the setting relative to the planing knife and relative to the wood block to be processed causes problems. Width knives extending too far above the planing knife produce a lot of dust in the woodwool, because they do not always precisely follow the same path in carriage planing machines during the forward and during the backward stroke, and because they do not cut grooves at exactly the same position as width knives mounted ahead of the successive planing knife in rotating planing machines. This disadvantage is increased by transversal movements of the wood and/or the carriage.

All types of width knives have the disadvantage that while planing narrow woodwool the space between the width knives becomes that small that woodwool fibres get entangled and the interspaces between the knives get jammed up. As a result the slicing operation has to be stopped in order to be able to clean the width knives. This phenomenon renders it impossible to slice narrow woodwool using width knives, as is desired for packaging purposes or for aesthetically high quality cement-bonded ceiling panels.

In view of the above one has searched for other possibilities for determining the width of the woodwool fibres. These possibilities are provided in the form of so-called comb or profiled knives, as illustrated in U.S. Pat. No. 2,576,190. However, it is a disadvantage of these profiled knives that they cannot or hardly be used for second choice wood, showing cracks, knots and irregularly extending growing fibres. The projecting high wood ribs formed by planing already break before the following cutting edges can slice a second series of woodwool strands at that location. The strips being cut by the tooth points of these profiled knives often follow in an uncontrolled way the irregularly extending growing fibres, such that large pieces break loose from the wood block. Further splinters and, in the case of narrow woodwool, the fibres are clamped into the deep grooves of the profiled knives, whereas sometimes the high small teeth of the profiled knives can break off on hard knots in the wood.

An other alternative is shown by European patent application 19,614, according to which a profiled knife and a flat knife are positioned behind each other. In this case for example a profiled knife with alternating 4 mm wide teeth and 4 mm wide recesses and a following flat knife are used for slicing 4 mm wide woodwool fibres, for example. Using this combination the slicing operation occurs with both knives using the point of the knife and the profiled knife is positioned slightly higher than the smooth knife, such that by means of the profiled knife strands of woodwool are sliced creating grooves in the wood block. These grooves are somewhat deeper than the desired thickness of the woodwool. Next using the flat knife subsequent woodwool fibres having the desired thickness are sliced from the ripples shaped thus. Meanwhile the grooves planed into the wood block by means of the profiled knife still partially remain.

Positioning a profiled knife and a smooth knife behind each other in correspondence with this publication offers the advantage, that the wood can be clamped in a slightly sloping manner, such that both knives in average cut "into" the growing fibre, but an important disadvantage is that with second choice wood, comprising knots and irregular fibre directions, it cannot be avoided that both knives slice irregularly thick fibres and often even splice off slices from the wood block instead of separate woodwool fibres with constant thickness and width. Such undesired phenomenons occur more often when the woodwool fibres to be produced have to be narrow, and slicing regularly shaped very fine woodwool is not possible at all.

Generally it may be noted, that an important disadvantage of the use of profiled knives is, that the side edges of the produced woodwool is ripped out of the grooves by means of the profiled knife instead of cut out. As a result at these side edges of the woodwool fibres frills and hairs are formed, which moreover disengage easily and create a lot of wood dust. Therefore the woodwool fibres, which are subsequently sliced during a successive step (for example by means of a smooth knife) from the remaining ripples neither comprise smoothly cut side edges.

As noted before the width of the woodwool varies because it is dependent upon the presence of, for example, dryness cracks, knots and the path of the growing fibres of the wood at the location of the tooth points of the profiled knives. Therefore the width of the fibres cannot be controlled and is not constant.

The problems mentioned before will increase in magnitude when the quality of the wood is less and the woodwool to be produced has to be narrow, such as if it has to be used for packaging purposes or in decorative ceiling panels, where slices, splinters, hairs and dust are unacceptable.

From the foregoing it has to be concluded that none of the techniques available at the present renders it possible to produce optimally shaped, regular woodwool.

It is an object of the invention to provide a solution.

SUMMARY OF THE INVENTION

Thus the knife assembly according to the invention is characterised by guiding ribs extending perpendicularly to the cutting edge and joining the chip surface with an end that substantially coincides with the cutting edge and with a guiding surface joining said end and rising there towards.

Surprisingly it appeared, that using such a knife assembly woodwool can be cut loose entirely from a wood block without ripping the side edges. The knife assembly may be compared with a profiled knife, of which the teeth are bevelled such that they do not any longer engage into the wood, but define ascending guiding surfaces therefore, and wherein between the teeth at the side of the chip surface grooves are defined which end at the clearance surface and at that position define the cutting edge. Due to the resilience of the wood the cutting edge parts may engage the wood, whereas the guiding surfaces support the wood. The cutting edge parts positioned between the teeth now cut loose the woodwool from the wood block, whereas the bevelled teeth (guiding surfaces) act as a support for the flanking parts of the wood block and support and withhold it in a favourable way. The rearward parts of the flanks of the teeth (or guiding ribs) take care of cutting loose the woodwool at the location of the side edges, such that all sided cut woodwool fibres are created.

It is also possible to consider the knife assembly according to the invention as a smooth knife per se, onto the chip surface of which said guiding ribs are positioned. The chip surface sections between the guiding ribs remain acting as fibre removal surfaces, of which the intersection with the clearance surface define all the cutting edges, which cut the woodwool from a wood block to be processed.

It is also possible that the guiding ribs are formed integrally with the knife; however it is possible too that the guiding ribs are part of another machine part and are pressed against the chip surface of the knife. For the final operation of the knife assembly this makes no difference.

In correspondence with a preferred embodiment of the knife assembly according to the invention the end of the guiding ribs practically coincides with the cutting edge of the knife. This means, that the remaining cutting edge parts between the guiding ribs are at the same level as the end of the guiding surfaces. As mentioned before it is the result of the resilience of the wood to be processed that not withstanding this fact these cutting edge parts can carry out a cutting operation for creating the woodwool fibres, even when the said ends are at a higher level than the cutting edge parts.

Further it is preferred, that the guiding ribs engage a run-up guide for a wood block to be cut up into fibres, said guide having a guiding surface which substantially joins the guiding surfaces of the guiding ribs. Like this it can be guaranteed that even with the most irregular growing fibres and with large dryness cracks no strips of wood are ripped off, because the inclined rising guiding surfaces of the guiding ribs are hidden between the guiding surface of the run-up guide. In this aspect it may be noted, that the most forward guiding surfaces of the guiding ribs may be positioned somewhat lower than the guiding surface of the run-up guide.

Further the knife assembly according to the invention may be characterised by auxiliary means engaging the chip surface between the guiding ribs and at some distance from the cutting edge of the knife. Using these auxiliary means the woodwool fibres produced may be removed from the grooves formed between the guiding ribs and/or curled in a simple way. Such auxiliary means may comprise the teeth of a comb knife.

Further the invention relates to an apparatus for producing woodwool, comprising a knife assembly according to the invention. Such an apparatus may be characterised by a reciprocating carriage and two knife assemblies positioned opposite to each other in said carriage, wherein the guiding ribs of said assemblies are mutually staggered. Further the possibility exists, that such an apparatus is characterised by a rotatable knife support, such as disc, roller, cone or alike, comprising positioned therein a number of knife assemblies, wherein the guiding ribs of successive knife assemblies have staggered radial positions.

BRIEF DESCRIPTION OF THE DRAWINGS

Hereinafter the invention will be elucidated referring to the drawing, in which a number of embodiments of the knife assembly according to the invention is illustrated.

FIG. 1 shows, perspectively, a first embodiment of a knife assembly according to the invention;

FIG. 2 shows a side elevational view of the knife assembly of FIG. 1;

FIG. 2*a* shows a side elevation view of an alternate embodiment of the knife assembly of FIG. 1 having an intermediate surface between the guiding and clearance surfaces;

FIG. 3 shows, perspectively, a second embodiment of a knife assembly according to the invention;

FIG. 4 shows a side elevational view of the knife assembly of FIG. 3;

FIG. 13 shows a rotatable knife support with a plurality of knife assemblies.

DETAILED DESCRIPTION OF THE PREFERRED EMBODIMENTS

Figure 5:
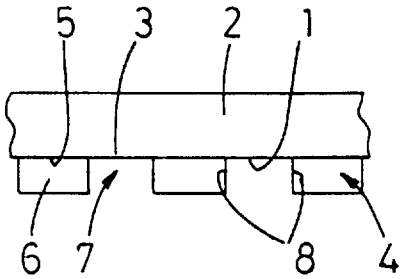
FIGS. 5 until 8 show a frontal view of variations of the knife assembly according to the invention.

The knife assembly illustrated perspectively in FIG. 1 mainly comprises a knife with a chip surface 1, a clearance surface 2 (positioned at the rearward side and thus not visible) and a cutting edge 3 defined by the intersection between both surfaces. On the chip surface 1 and perpendicularly to the cutting edge guiding ribs 4 extend of which an end 5 coincides with the cutting edge 3. Guiding surfaces 6 join each end 5.

FIG. 2 shows a side elevational view of the knife assembly illustrated in FIG. 1, clearly showing all parts. Further in FIG. 2 a dotted line indicates schematically the direction into which a wood block to be processed (coming from the right) moves relative to the knife assembly. From this direction it appears clearly, that the clearance surface 2 encloses a clearance angle with this direction, whereas the guiding surfaces 6 enclose with this direction an angle having opposite sign, and thus ascends in the direction of the end 5 of the guiding ribs 4.

Contrary to standardized profiled knives (or comb knives) the knife assembly according to FIG. 1 slices with the sections of the cutting edge 3 between the guiding ribs 4. The guiding surfaces 6 of the guiding ribs 4 (which might be compared with the teeth of a profiled knife) do not cut in this case, however take care for guiding an arriving wood block at both sides of those locations where the cutting edge sections 3 slice or cut. Although the cutting edge sections 3 are substantially at the same level as the ends 5 of the guiding surfaces 6 joining these it appears that these cutting edge sections slice regular woodwool fibres from the fed wood block. The guiding surfaces 6 and the ends 5 (which define the transition between these guiding surfaces 6 and the clearance surface 2) provide for a support of the wood block, such that no uncontrolled and unwanted disengagement of wood sections occurs. The grooves 7 defined between the guiding ribs 4 discharge the produced woodwool fibres.

It is assumed, that the operation of the knife assembly according to the invention is based upon the resilience of the wood, which at the guiding surfaces 6 is compressed slightly, while the interlaying sections are engaged by the cutting edge sections 3 between the ends 5. Due to the cooperation between the different parts of the knife assembly regular woodwool fibres comprising no frills or hairs are produced. The depth of these woodwool fibres is cut by the cutting edge sections 3 between the ends 5, whereas the width is cut by the rearward parts of the flanks 8 of the guiding surfaces 6. Dryness cracks, knots or irregularities of the growing fibres then do no longer have any, influence on the shape of the woodwool fibres produced.

In FIGS. 3 and 4 an alternative embodiment of the knife assembly according to the invention is illustrated. Whereas in FIG. 1 the guiding ribs 4 so to say are positioned onto the chip surface 1, according to FIG. 3 the chip surface 10 is defined by grooves 9 which are provided starting from a smooth knife. The difference appears clearly too from a comparison between FIG. 2 and FIG. 4, wherein according to FIG. 2 the chip surface 1 coincides with the main plane 11 of the knife, whereas in FIG. 4 the chip surface 10 is offset relative to the main plane 11, whereby the surface of the ribs 4 is positioned in said main plane 11.

The knife assemblies illustrated may be obtained too by sharpening the points of a combing or profiled knife known per se at an appropriate angle, whereafter the grooves 7 or 9 are shaped between the teeth.

Because in both embodiments the chip surface 1 or 10, respectively, extends in parallel with the surface of the guiding ribs 4, the knife assemblies illustrated are very good sharpenable.

FIGS. 1 and 3 show embodiments according to which the guiding ribs 4 are integrally shaped with the knife. However it is possible too that the guiding ribs make part of another machine part, and are placed against the knife in the desired position.

In the embodiments shown the guiding surfaces 6 with their ends 5 exactly join the cutting edge 3. However, this is not necessary and the resilience of the wood allows that the cutting edge 3 is at a lower level than these ends 5.

Further it is possible that at the ends 5 roundings or intermediate surfaces 5' are shaped, such that the guiding surfaces 6 gradually merge into the clearance surface 2, such as shown in FIG. 2*a*.

Figure 6:
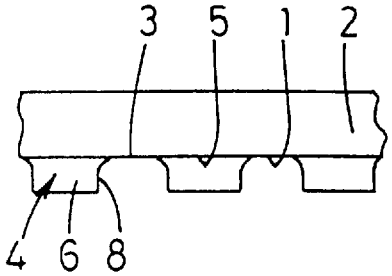
Figure 7:
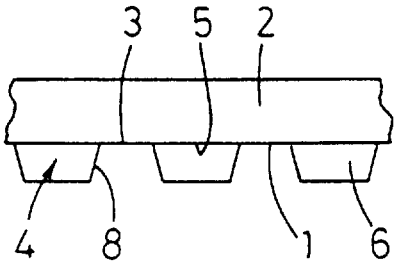
Figure 8:
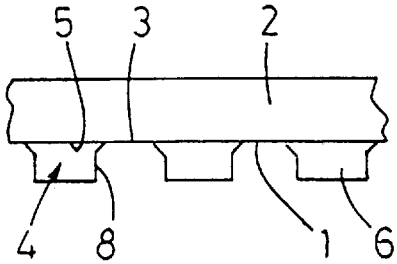

With respect to the shape of the guiding ribs 4 several possibilities exist. FIG. 5 shows a frontal view of the knife assembly with the shape according to FIG. 1 and 3, the guiding ribs 4 having a right-angled section. However it is possible too (FIG. 6) that the flanks 8 of the guiding ribs 4 merge into the cutting edge 3 through the arc of a circle, that the flanks 8 are inclined and the guiding ribs 4 have a trapezoidal section (FIG. 7), or that the transition between the flanks 8 and the cutting edge 3 occurs through an inclined straight surface (FIG. 8). Of course combinations thereof are possible too. Moreover the width of the grooves 7 or 9, respectively, does not have to be equal to the width of the guiding ribs 4, but may differ therefrom; preferably the width of groove will be larger than the width of the guiding ribs. For different kinds of wood to be processed in each case the most optimal shapes of the guiding ribs have to be determined, among others dependent upon the cutting resistance to be expected and the hardness and elasticity of the respective kind of wood.

By choosing the appropriate shape of the grooves it is possible to slice woodwool according to a honeycomb profile having obtuse angles or bows, thus further decreasing the tendency of the occurrence of frills and dust. Among others due to this the knife assemblies according to the invention are extremely fit to be used in the production of fine packaging wool and in the production of high quality cement-bonded ceiling panels, for example of the acoustic kind, having an open surface structure.

If the knife assembly according to the invention is applied in a planing machine having a cutting operation in one direction it is possible to provide successively a number of those knife assemblies, wherein the guiding ribs each are offset relative to each other. The half high ribs remaining on top of the wood block to be processed after the passage of a knife assembly are planed down by a successive knife assembly while forming new, offset, half-high ribs. Like this the wood block is successively sliced into pieces. The same occurs with planing devices comprising a rotating disc, wherein the radial position of the guiding ribs of successive knife assemblies is offset too. In such an apparatus there will generally be an even number of knife assemblies.

Figure 9:
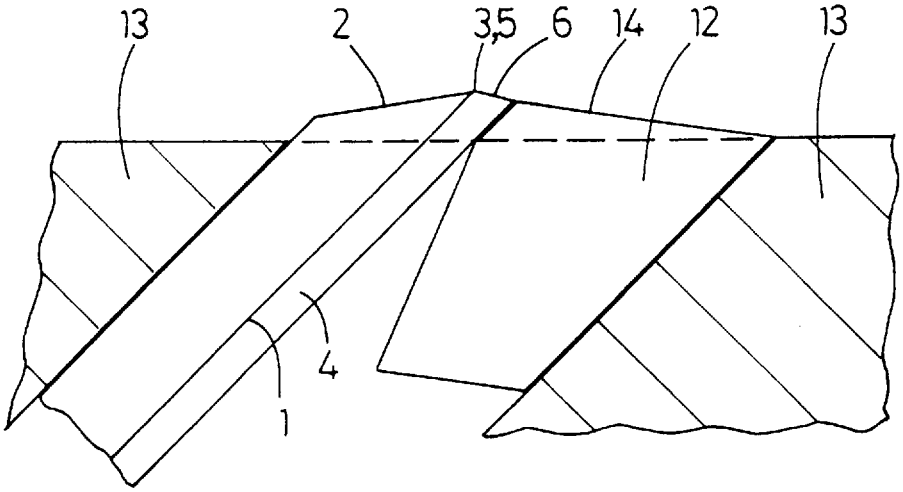
FIG. 9 shows a detail of an apparatus comprising the knife assembly according to the invention.

FIG. 9 shows part of an embodiment of a planing machine, in which there is applied a knife assembly according to the invention. One can see that the guiding ribs 4 with their points rest against a run-up guide which, in correspondence with the knife assembly, is mounted in a machine part 13. The machine part illustrated can be a reciprocating carriage or a rotating disc. In the embodiment shown the guiding surfaces 6 join a guiding surface 14 of the run-up guide 12. The slope of the guiding surfaces 6 of the guiding ribs 4 is illustrated to be somewhat larger than the slope of the guiding surface 14. However this is not necessary. Among others the most appropriate slopes are dependent upon the kind of wood.

It is possible too, that the guiding surfaces 6 with their end joining the run-up guide 12 are positioned slightly below the guiding surface 14 of the run-up guide. In each case the run-up guide 12 prevents that using the knife assembly large strips of wood are ripped off of a wood block to be processed, as might happen with normal profiled knives.

Figure 10:
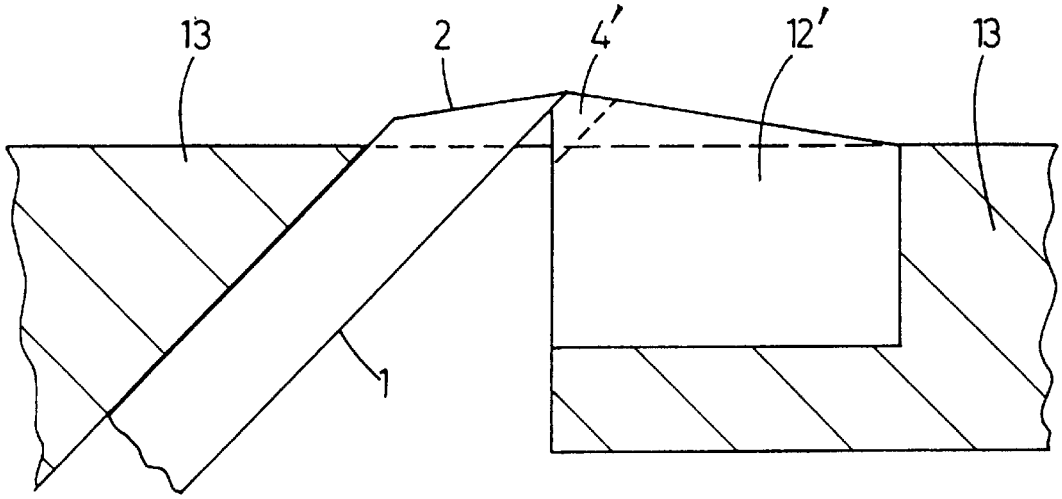
FIG. 10 shows an alternative embodiment in correspondence with FIG. 9.

FIG. 10 shows an embodiment of a-knife assembly according to the invention, in which the guiding ribs 4' are part of a run-up guide 12'. This embodiment differs from the embodiment according to FIG. 9 in that the guiding ribs are no part of the knife, but are connected with the run-up guide. As a result it is possible that a (planar) flat knife is applied which can be easily sharpened. The depth of the grooves in the run-up guide is sharpenable too, but it is not possible to provide the grooves with each desired shape. Thus it is not possible that the flanks of the guiding ribs merge into the cutting line of the knife through the arc of a circle or through an obtuse angle.

Figure 11:
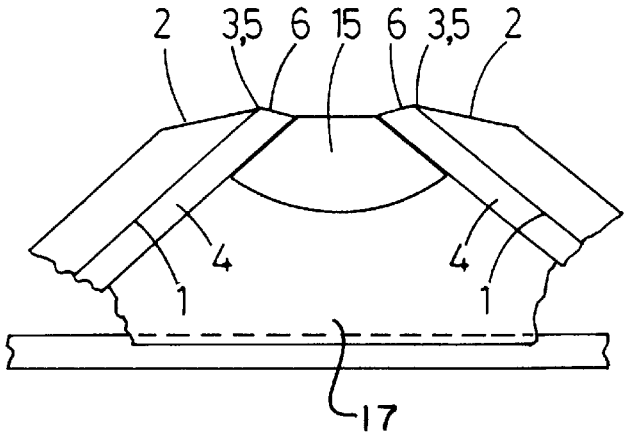
FIG. 11 shows another apparatus comprising two knife assemblies according to the invention.

In FIG. 11 part of an embodiment of a reciprocating planing device is shown with two oppositely positioned knife assemblies positioned in a reciprocating carriage 17.

Between both knife assemblies there is a guiding strip 15 supporting the knives and offering in both directions of movement of the knife assemblies an operation in correspondence with the operation of the run-up guide 12 according to FIG. 9. Of course in this embodiment again both knife assemblies are offset relative to each other, such that the grooves of one knife assembly are opposite to the guiding ribs of another knife assembly. The guiding strip may enclose the tips of the teeth with grooves such that the knife assemblies and the guiding strip support each other.

Figure 12:
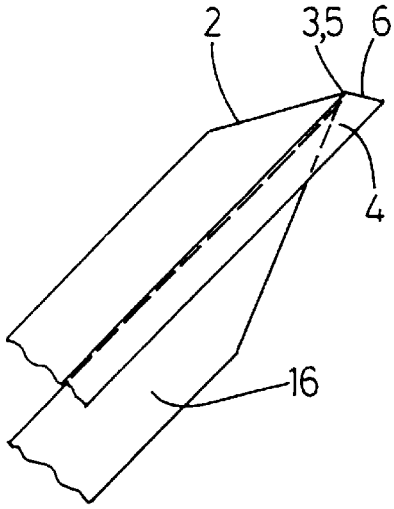
FIG. 12 shows a knife assembly comprising an auxiliary means.

Finally FIG. 12 shows, that between the guiding ribs 4 and at some distance from the cutting edge 3 of the knife auxiliary means engaging the chip surface of the knife can be provided, which in this case comprise a comb knife 16 of which the teeth engage into the grooves between the guiding ribs 4. Using such a comb knife 16 it is prevented that the grooves get jammed up. Especially when dealing with certain kinds of wood having a differing elasticity, or a high degree of moisture, or if certain chemical (for example sticky) substances, such as resin, are present this can be important. Further the positioning and shape of the comb knife 16 can provide an extra curling of the woodwool chips being produced.

FIG. 13 shows a rotatable knife support 30 with a plurality of staggered knife assemblies 20 mounted on it. The guiding ribs of successive knife assemblies 20 have staggered radial positions. A rotating disk support is shown. However, other rotatable knife supports such as rollers or cones may also be used.

The invention is not limited to the embodiments described before, which can be varied widely within the scope as defined by the claims.

The knife assembly according to the invention also may be applied with advantage for slicing shorter or wider so-called "flakes", to be used for "flake-boards". In such a case as a rule the knives move transversally relative to the growing fibres and the knives are for example clamped in wide rollers or cones, whereas the wood with its growing fibre is positioned in parallel to the axis of the roller and is supplied radially thereto.

I claim:

1. A knife assembly for slicing woodwool, comprising:

a knife with a chip surface, a clearance surface and a cutting edge defined by the intersection between said chip and cutting surfaces; and a plurality of guiding ribs extending perpendicularly to the cutting edge, each said rib joining the chip surface with an end that substantially coincides with the cutting edge and having a guiding surface joining said end and rising there towards to form a non-cutting region adjacent said cutting edge.

2. The knife assembly of claim 1 wherein the guiding ribs are formed integrally with the knife.

3. The knife assembly of claim 1 wherein the end of the guiding ribs substantially coincides with the cutting edge of the knife.

4. The knife assembly of claim 1 wherein the guiding surfaces join the clearance surface of the knife by means of an intermediate surface.

5. The knife assembly of claim 1 wherein the width of the guiding surface of the guiding ribs is smaller than the mutual distance between the guiding ribs.

6. The knife assembly of claim 1 wherein the guiding surfaces have, at their end facing away from the cutting edge, a smaller width than at their end facing the cutting edge.

7. A knife assembly of claim 1, wherein the side edges of the guiding surfaces connect to the cutting edge by means of a bent edge.

8. The knife assembly of claim 1 wherein the guiding ribs engage a run-up guide for a wood block to be cut up into fibres, said guide having a guiding surface which substantially joins the guiding surfaces of the guiding ribs.

9. The knife assembly of claim 8 wherein the guiding surfaces of the guiding ribs are positioned slightly below the guiding surface of the run-up guide.

10. The knife assembly of claim 1, further comprising auxiliary means engaging the chip surface between the guiding ribs and at some distance from the cutting edge of the knife.

11. The knife assembly of claim 10, wherein the auxiliary means comprise teeth of a comb knife.

12. An apparatus for producing woodwool, comprising:

a support assembly and at least one knife assembly as recited in claim 1 positioned therein.

13. The apparatus of claim 12, wherein said support assembly comprises a reciprocating carriage having two knife assemblies positioned opposite each other in said carriage, wherein the guiding ribs of said knife assemblies are mutually staggered.

14. The apparatus of claim 13, wherein a guide strip is positioned between the knife assemblies, joining the guiding ribs thereof.

15. The apparatus of claim 12, wherein:

said support assembly comprises a rotatable knife support having at least two of said knife assemblies positioned therein, and wherein the guiding ribs of successive knife assemblies have staggered radial positions.

16. A woodwool produced using the apparatus of claim 12.

* * * * *